US011054093B2

(12) United States Patent
Carton et al.

(10) Patent No.: US 11,054,093 B2
(45) Date of Patent: Jul. 6, 2021

(54) MODULAR LIGHTING SYSTEM

(71) Applicant: Power Probe TEK, LLC, Brea, CA (US)

(72) Inventors: Joshua Carton, Wilmington, CA (US); Wayne Russell, Ontario, CA (US)

(73) Assignee: POWER PROBE GROUP, INC., Brea, CA (US)

( * ) Notice: Subject to any disclaimer, the term of this patent is extended or adjusted under 35 U.S.C. 154(b) by 0 days.

(21) Appl. No.: 15/900,635

(22) Filed: Feb. 20, 2018

(65) Prior Publication Data

US 2019/0257484 A1 Aug. 22, 2019

(51) Int. Cl.

| | |
|---|---|
| ***F21S 2/00*** | (2016.01) |
| ***F21V 21/40*** | (2006.01) |
| ***F21V 23/00*** | (2015.01) |
| ***F21V 21/34*** | (2006.01) |
| ***F21S 9/02*** | (2006.01) |
| ***F21V 23/04*** | (2006.01) |
| ***F21V 21/096*** | (2006.01) |
| ***H05B 47/19*** | (2020.01) |
| *F21W 131/402* | (2006.01) |
| *F21Y 115/10* | (2016.01) |

(52) U.S. Cl.

CPC ..... *F21S 2/005* (2013.01); *F21S 9/02* (2013.01); *F21V 21/096* (2013.01); *F21V 21/34* (2013.01); *F21V 21/40* (2013.01); *F21V 23/001* (2013.01); *F21V 23/04* (2013.01); *H05B 47/19* (2020.01); *F21W 2131/402* (2013.01); *F21Y 2115/10* (2016.08)

(58) Field of Classification Search

CPC .. F21S 2/005; F21S 9/02; F21V 21/34; F21V 21/04; F21V 21/40; F21V 21/096; F21V 23/001; F21V 23/0435; F21Y 2113/20; F21W 2131/402

See application file for complete search history.

(56) References Cited

U.S. PATENT DOCUMENTS 6,520,661 B1 * 2/2003 Hill ..... F21V 21/096 362/249.01
8,184,445 B2 * 5/2012 Jacobs ..... F21V 21/096 361/760

(Continued)

FOREIGN PATENT DOCUMENTS

DE 102006018298 * 10/2007 ..... F21S 2/00

OTHER PUBLICATIONS

English Machine Translation of DE 102006018298 provided by ESPACENET (Year: 2006).*

*Primary Examiner* — Zheng Song
(74) *Attorney, Agent, or Firm* — Patrick B. Horne; Shumaker, Loop & Kendrick, LLP

(57) ABSTRACT

An apparatus and a method are provided for a modular lighting system. In one embodiment, the modular lighting system comprises a compact and lightweight outer enclosure that features a plurality of lighting elements. It is envisioned that a subsection of the lighting elements is static, in that it may not be removed from the outer enclosure. The plurality of lighting elements are configured so that they may be detached from the outer enclosure and placed at locations based on the user's discretion so as to substantially reduce shadows and illuminate key areas. The modular lighting system may be operated wirelessly. In at least one embodiment, the detachable lighting elements include independent power sources.

11 Claims, 10 Drawing Sheets

(56) References Cited

U.S. PATENT DOCUMENTS

| | | | | |
|---|---|---|---|---|
| 2005/0018435 | A1* | 1/2005 | Selkee | F21L 4/02 362/427 |
| 2008/0117622 | A1* | 5/2008 | Lin | F21V 33/008 362/92 |
| 2008/0239730 | A1* | 10/2008 | Chien | F21L 14/02 362/368 |
| 2012/0243227 | A1* | 9/2012 | Shimizu | F21S 8/04 362/249.01 |
| 2013/0033195 | A1* | 2/2013 | Liao | F21S 9/032 315/294 |
| 2013/0170211 | A1* | 7/2013 | Lin | F21S 2/005 362/249.02 |
| 2014/0226325 | A1* | 8/2014 | Allen | F21V 21/088 362/231 |
| 2017/0370537 | A1* | 12/2017 | Wu | F21V 17/02 |
| 2018/0231193 | A1* | 8/2018 | Bian | F21L 4/02 |
| 2019/0154214 | A1* | 5/2019 | Selevan | B65D 25/20 |
| 2019/0285251 | A1* | 9/2019 | Li | F21V 21/40 |

* cited by examiner

MODULAR LIGHTING SYSTEM

FIELD

The field of the present disclosure generally relates to work lights. More particularly, the field of the invention relates to an apparatus and a method for a modular lighting system that may be advantageously configured into multiple lighting sources.

BACKGROUND

Automotive technicians are often responsible for performing maintenance on vehicles, as well as diagnosing problems. For example, an automotive technician may perform engine oil changes and tune-ups to keep vehicles in good working condition. Because technicians usually work in tight spaces that may also be dark, having proper lighting is crucial. The issue of dark spaces is exacerbated by the many shadows that are cast in an engine compartment due to the volume of automotive components located in the compartment. Effective lighting is important for safety of the technician, as well as enabling the technician to accurately see and better perform work on the vehicle.

A drawback to conventional lighting systems is that not all required surfaces can be desirably lit at the same time with a single lighting source. As a result, the technician is forced to use larger and brighter lights or light sticks to insert into the engine compartment. Unfortunately, the larger lights produce significant amounts of heat, especially if a particular troubleshooting area requires many hours of attention. Moreover, the larger lights often fail to illuminate the desired area. Singular lighting sources are also cumbersome in that they must be moved multiple times during a single project so as to provide the desired lighting, undesirably increasing the time required to finish a project. Utilization of multiple lighting sources may also be cumbersome due to the associated costs, and the increased clutter in the workspace. Finally, multiple lighting sources often require multiple power sources and corresponding runs of power wire, which may present a hazard in inherently dangerous working areas.

What is needed, therefore, is a modular lighting system that provides light from a plurality of sources that is capable of being manipulated in and around work areas without introducing any of the safety issues associated with conventional solutions.

BRIEF DESCRIPTION OF THE DRAWINGS

The drawings refer to embodiments of the present disclosure in which.

Figure 1:
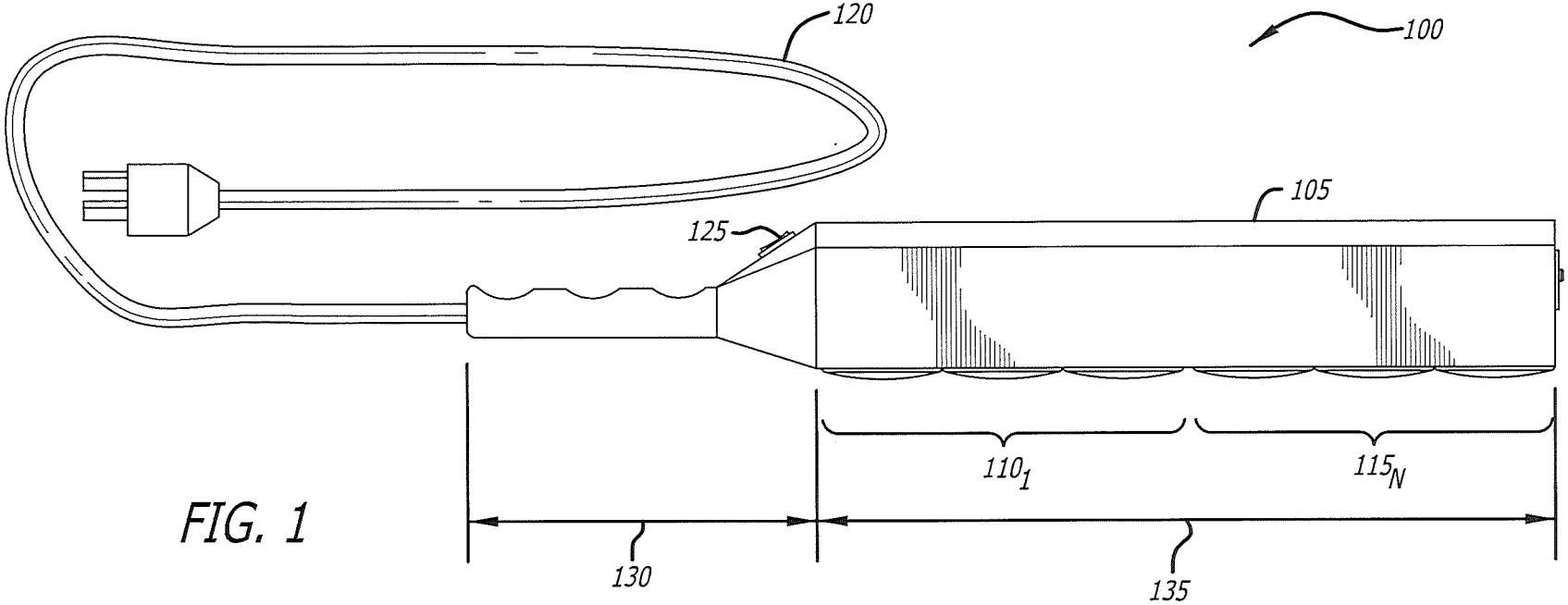
FIG. 1 is a side plan view of an exemplary embodiment of a modular lighting system in accordance with principles of disclosure.

While the present disclosure is subject to various modifications and alternative forms, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the invention disclosed herein may be practiced without these specific details. Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

In general, the present disclosure describes an apparatus and a method for modular lighting system. In one embodiment, the modular lighting system comprises a compact and lightweight outer enclosure that features a plurality of lighting elements. It is envisioned that a subsection of the lighting elements is static, in that it may not be removed from the outer enclosure. Notably, the plurality of lighting elements are configured so that they may be detached from the outer enclosure and placed at locations based on the user's discretion so as to substantially reduce shadows and illuminate key areas.

In one embodiment, a modular lighting system is disclosed, comprising: an enclosure configured to retain a static lighting element and a plurality of detachable lighting elements, wherein the enclosure includes a handle portion; a detachable power cable extending from the handle portion that is capable of being communicatively coupled to a power source; and wherein each of the detachable lighting elements feature a lighting source and an independent power source.

In another embodiment, the modular lighting system, at least three detachable lighting elements are provided. In yet another embodiment, the lighting source of each of the detachable lighting elements comprises a series of light emitting diodes (LEDs).

In one embodiment, the enclosure features a unifying member that is configured to engagingly couple with a base area of each of the detachable lighting elements. In another embodiment, the enclosure features a plurality of internal retaining protrusions so as to guide and align the plurality of detachable lighting elements in the enclosure. In yet another embodiment, the detachable lighting elements comprise an outer-most lighting element that features a mounting plate configured so as to retain the lighting elements in the enclosure.

In one embodiment, base areas comprise a means for attaching the detachable lighting elements to a surface. In another embodiment, each of the detachable lighting elements comprise a charge port that is configured so as to receive the unifying member for the purposes of power and function control. In yet another embodiment, the static lighting element and the plurality of detachable lighting elements may be utilized without being coupled to the power cable. In one embodiment, the detachable lighting elements feature a region capable of storing one or more batteries.

In one embodiment, the plurality of detachable lighting elements may be detached separately from the handle portion. In another embodiment, the plurality of detachable lighting elements may be controlled independently via a control interface. In yet another embodiment, each of the plurality of detachable lighting elements may be controlled via one or more inputs on the handle so as to apply various lighting functions. In one embodiment, each of the detachable lighting elements may be controlled via Bluetooth.

FIG. 1 is a side plan view of an exemplary embodiment of a modular lighting system in accordance with principles of the disclosure. In one embodiment, the modular lighting system 100 features a substantially hollow enclosure 105 that is configured so as to retain a static lighting element 110 and a plurality of detachable lighting elements $\mathbf{115}_N$, N>2. In one embodiment, the enclosure 105 features a substantially trapezoidal cross-sectional shape, however it should be understood that a plurality of other shapes may be used without limitation. The enclosure 105 tapers at its proximal end 132 into a handle portion 134 that is configured so as to be comfortably held by the user. In one embodiment, the enclosure 105 may be comprised of an aluminum-based material. In one embodiment, the enclosure 105 may be comprised of a thermoplastic polymer, such as acrylonitrile butadiene styrene (ABS). In one embodiment, the enclosure 105 may be comprised of a combination of aluminum-based material and ABS. In one embodiment, the enclosure 105 may be comprised of carbon fiber and/or titanium for aesthetic purposes. In some embodiments, a gripping component may be disposed on the enclosure 105.

In one embodiment, a power switch 125 is disposed on the handle portion 134 so as to provide operable functionality (such as power) to the modular lighting system 100. It should be understood that the power switch 125 may be disposed at alternative locations without limitation. A power cable 120 extends from the handle portion 134 so as to be communicatively coupled to a power source, for example. In one embodiment, the handle portion 134 is substantially 7.05". Similarly, in one embodiment, the enclosure 105 has a length of substantially 14.70". In one embodiment, the handle portion 134 may include a plurality of indentations that may be molded so as to facilitate grasping and handling the modular lighting system 100 in a user's hand.

Figure 2:
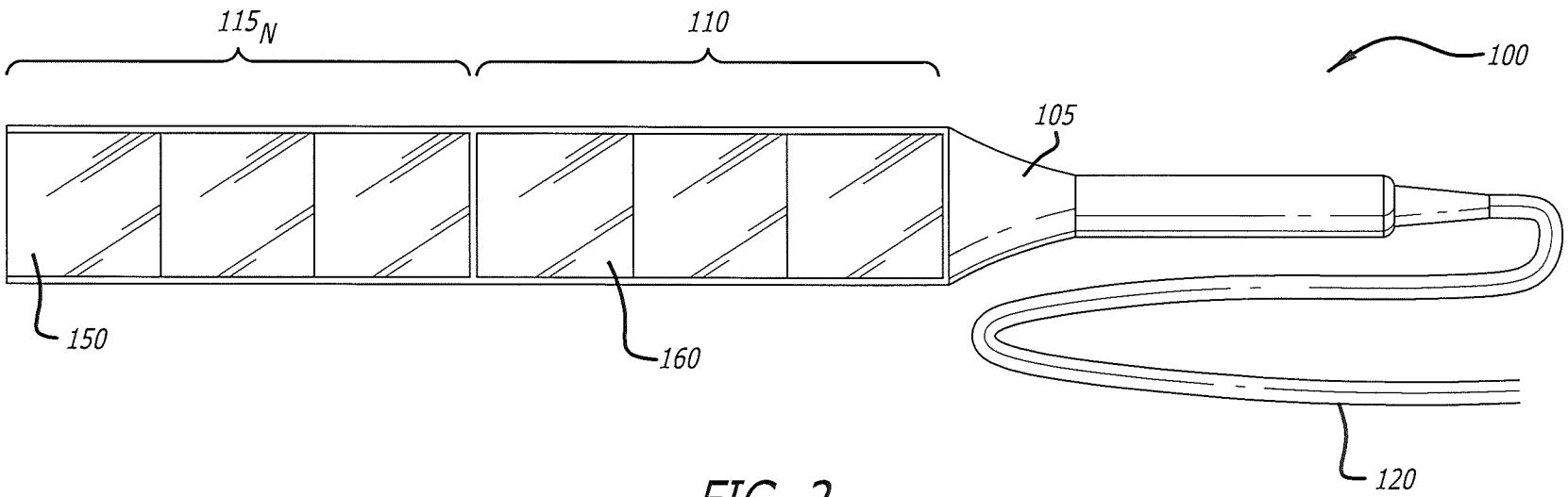
FIG. 2 is a perspective view of exemplary embodiments of lighting elements of the modular lighting system of FIG. 1 in accordance with principles of disclosure.

FIG. 2 is a perspective view of exemplary embodiments of lighting elements of the modular lighting system of FIG. 1 in accordance with principles of the disclosure. As shown, in one embodiment, the static lighting element 110 comprises three separate lighting subsystems $\mathbf{110}_{1\text{-}3}$, however, it should be understood that the static lighting element 110 may be configured as a singular lighting system. With respect to the plurality of detachable lighting elements $\mathbf{115}_N$, N>2, in one embodiment, it is envisioned that N=3, although the exact number may vary based on the size and desired dimensions of the modular lighting system 100.

Figure 3:
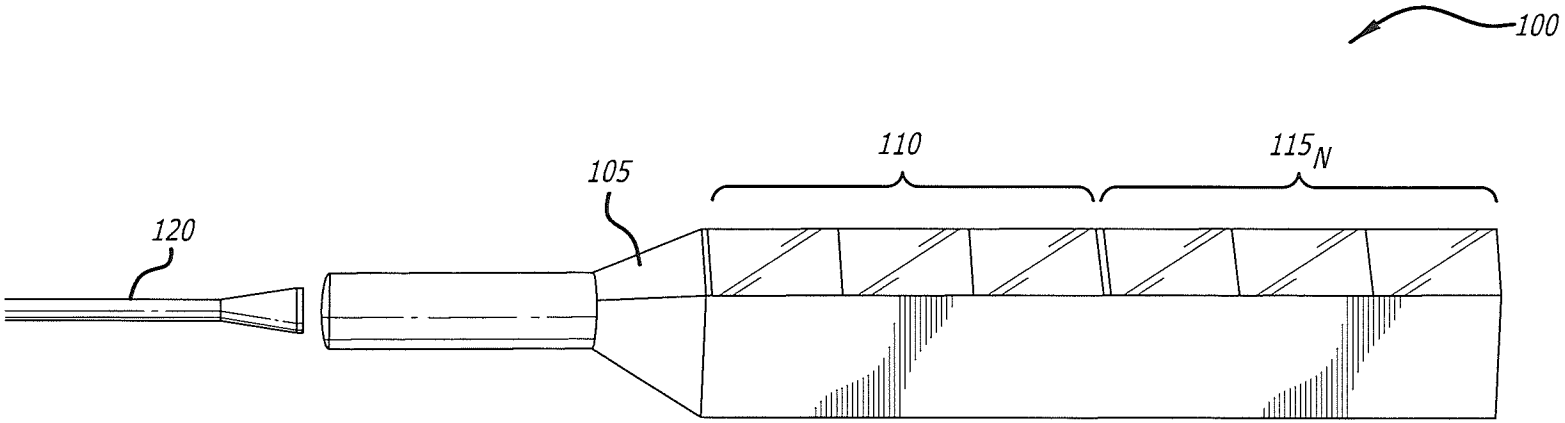
FIG. 3 is a perspective view of an exemplary embodiment of the cordless capability of the modular lighting system of FIG. 1 in accordance with principles of disclosure.

FIG. 3 is a perspective view of an exemplary embodiment of the cordless capability of the modular lighting system of FIG. 1 in accordance with principles of the disclosure. As shown, the power cable 120 is adapted so as to have a cordless configuration. As such, it should be appreciated that the enclosure 105 includes an internal battery (not shown) that may be charged when the power cable 120 is attached to a power source, for example. It is envisioned that the cordless configuration of the modular lighting system 100 provides additional flexibility with respect to placement, as well as providing the benefit of decreasing issues with respect to safety.

Figure 4:
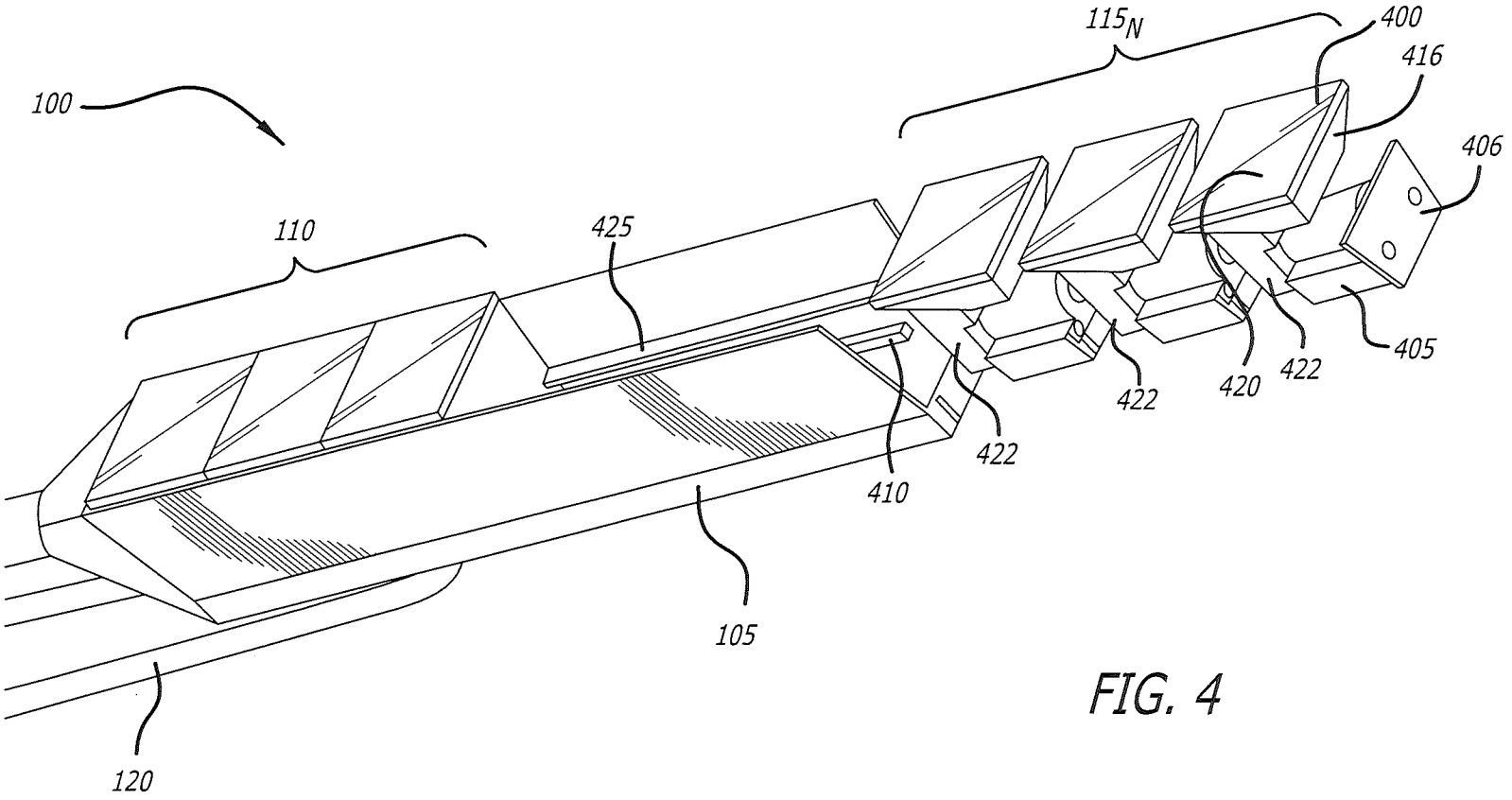
FIG. 4 is an upper perspective view of the modular lighting system of FIG. 1.

FIG. 4 is an upper perspective view of the modular lighting system of FIG. 1. As shown, each of the detachable lighting elements $\mathbf{115}_N$, N>2 are configured so as to operate as separate and independent lighting sources. In other words, each of the lighting elements $\mathbf{115}_N$ may illuminate a particular area requiring light. Each of the lighting elements $\mathbf{115}_N$ are envisioned to be compact, and in one embodiment have dimensions of substantially 2.5"-2.7" on all sides. It should be understood, however, that the dimensions may be varied as necessary in view of the end configuration without straying beyond the spirit of the disclosure.

As shown, each of the lighting elements $\mathbf{115}_N$ feature a base $\mathbf{405}_N$ that is configured so as to mate with one or more internal retaining elements within the enclosure 105; a housing 416 that is configured to retain one or more light sources 420; and an interface retaining medium 422. Each of the lighting elements $\mathbf{115}_N$ feature a diffuser 400 that may vary in opacity and color as the usage so requires. For example, in certain conditions an uninterrupted white light may be preferred, and thus the diffuser 400 may have a limited opacity. In one embodiment, the base 405 and/or the interface retaining medium 422 feature various electronic circuitry and components, such as by way of non-limiting example, voltage regulators, a power supply, control circuitry, wiring, and the like. In one embodiment, the base 405 and/or the interface retaining medium 422 may further include a region capable of storing one or more disposable and/or rechargeable batteries.

In one embodiment, the lighting sources 420 may comprise one or more light emitting diodes (LEDs) disposed in any number of different configurations. However, because the light produced by an individual LED is conventionally directional and focused, it is preferable to use a plurality of LEDs in the embodiments as discussed herein. Using arrays or groups of LEDs, as well as lenses or optics, a LED lighting product can provide light over a larger area, for either ambient or task functions. In general, LEDs are driven by constant current (350 mA, 700 mA or 1A) drivers or constant voltage (10V, 12V or 24V) drivers. It is contemplated that constant current drivers may fix the current of and vary the voltage of embodiments as discussed herein, depending on the load of the LED. As most constant voltage drivers require a fixed voltage, the LED loads may be added in parallel across the output of their respective driver(s) until maximum or desired output currents are reached.

In one exemplary embodiment, the LEDs may take the form of LED strips, although the individual LEDs may take any form, size or color. As will be appreciated, the LEDs may be of the single-die, medium power variety, or may be high-power, as well as any combination thereof. In one embodiment, the LEDs may be a single color, such as by way of non-limiting example, red, green, blue, white (cold or warm), yellow, and the like. Preferably, the LED strips may be of a flexible variety. In one embodiment, the LED strips comprise an adhesive so that they may be disposed as required in the modular lighting system 100. In one embodiment, the LED strips may be analog, and thus have a single color which may be changed by way of a remote controller, or other equivalent mechanism. In yet another embodiment, the LED strips may be digital, such that the color of each individual LED may be changed so as to enable creating various screens and effects. As those skilled in the art will appreciate, any number of LEDs may be implemented on a particular LED strip. For example, LED strips typically comprise 30, 42, 60 or 120 LEDs per meter. It will be further appreciated that utilizing relatively more LEDs generates a higher intensity of smooth light.

In one embodiment, the lighting source 420 may comprise one or more fiber optic strips. In one embodiment, the lighting source 420 may include one or more side illumination fiber optic light guides. In one embodiment, the lighting source 420 may be a combination of various types of lighting sources. Fiber optic light guides may transmit light through glass optical fibers. In one embodiment, the lighting source 420 may comprise one or more flexible side glow fiber optic solid cores, which are well suited for linear fiber optic lighting applications such as neon replacement, cove lighting, accent lighting, as well as lighting a work area.

Figure 5:
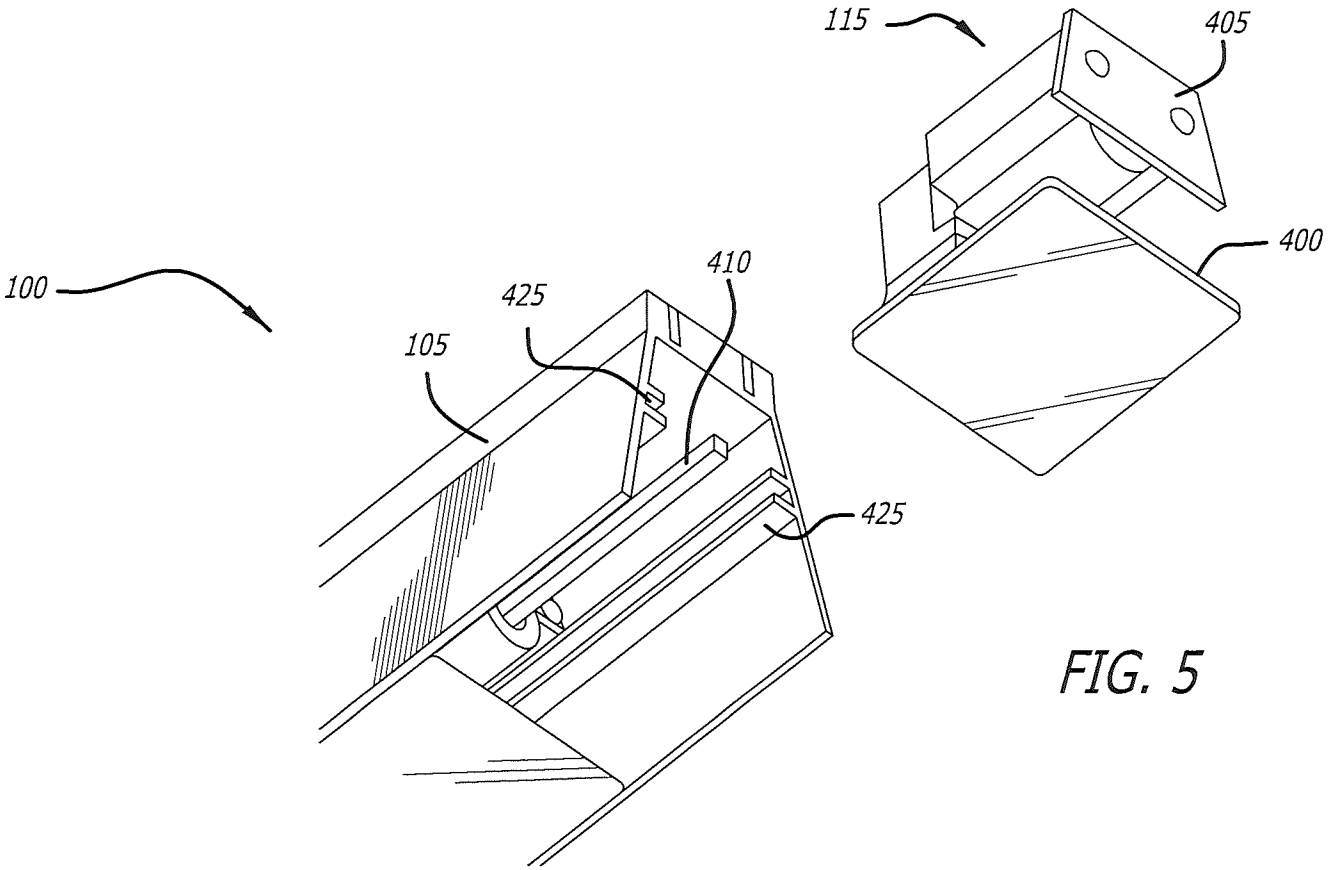
FIG. 5 is a lower perspective view of the modular lighting system of FIG. 1.

FIG. 5 is a lower perspective view of the modular lighting system of FIG. 1, which illustrates further details regarding the modular nature of the lighting system 100. As shown, the enclosure 105 includes a unifying member 410 that is configured to engagingly couple with the base area $\mathbf{405}_N$ of the lighting element $\mathbf{115}_N$, for example. It should be understood that in one embodiment, the unifying member 110 may be comprised of a substantially conductive material, such as metal, so that various control functions may be applied with respect to each of the lighting element $\mathbf{115}_N$. For example, in one embodiment, the unifying member 110 communicatively couples each of the lighting elements $\mathbf{115}_N$ with the power switch 125.

The enclosure 105 also features a plurality of internal retaining protrusions 425 that are configured to guide and align the plurality of lighting element $\mathbf{115}_N$, especially when manipulated in and out of the enclosure 105. As shown, the base 405 of the outer-most lighting element $\mathbf{115}_N$ includes a mounting plate 406, that is retained using a plurality of fasteners 407. In one embodiment, it is envisioned that the base 405 features circuitry so as to independently control the lighting element $\mathbf{115}_N$, wherein such controls include on/off and dimming functions. It will be understood that such independent control necessarily will include a corresponding control interface that may include any number of screens, touch screens, buttons, and switches. The control interface may also be implemented external to the device, using any wireless means of communication, including but not limited to Wi-Fi, Bluetooth, and the like. Wireless control of the lighting systems described herein may also be preferred in certain instances, such that mobile devices may be used to turn individual lights on or off, control brightness, color, frequency, format and the like. In instances where a wireless control interface is implemented in either the static lighting element 110 and/or the plurality of detachable lighting elements $\mathbf{115}_N$, necessary wireless communication hardware may be disposed therein, respectively. Specifically, wireless adapters, antennas, radio transmitters, receivers and the like are contemplated as being included in the modular lighting system. Simply put, it is contemplated that the modular lighting system may have wireless control and access capabilities without exceeding beyond the spirit and scope of the present disclosure.

In one embodiment, the control interface may also be included on each of the lighting elements $\mathbf{115}_N$. In one embodiment, the base 405 includes a securing means (not shown) that may be used to fasten the lighting element $\mathbf{115}_N$ to the hood of a car, or any other location, for example.

Figure 6:
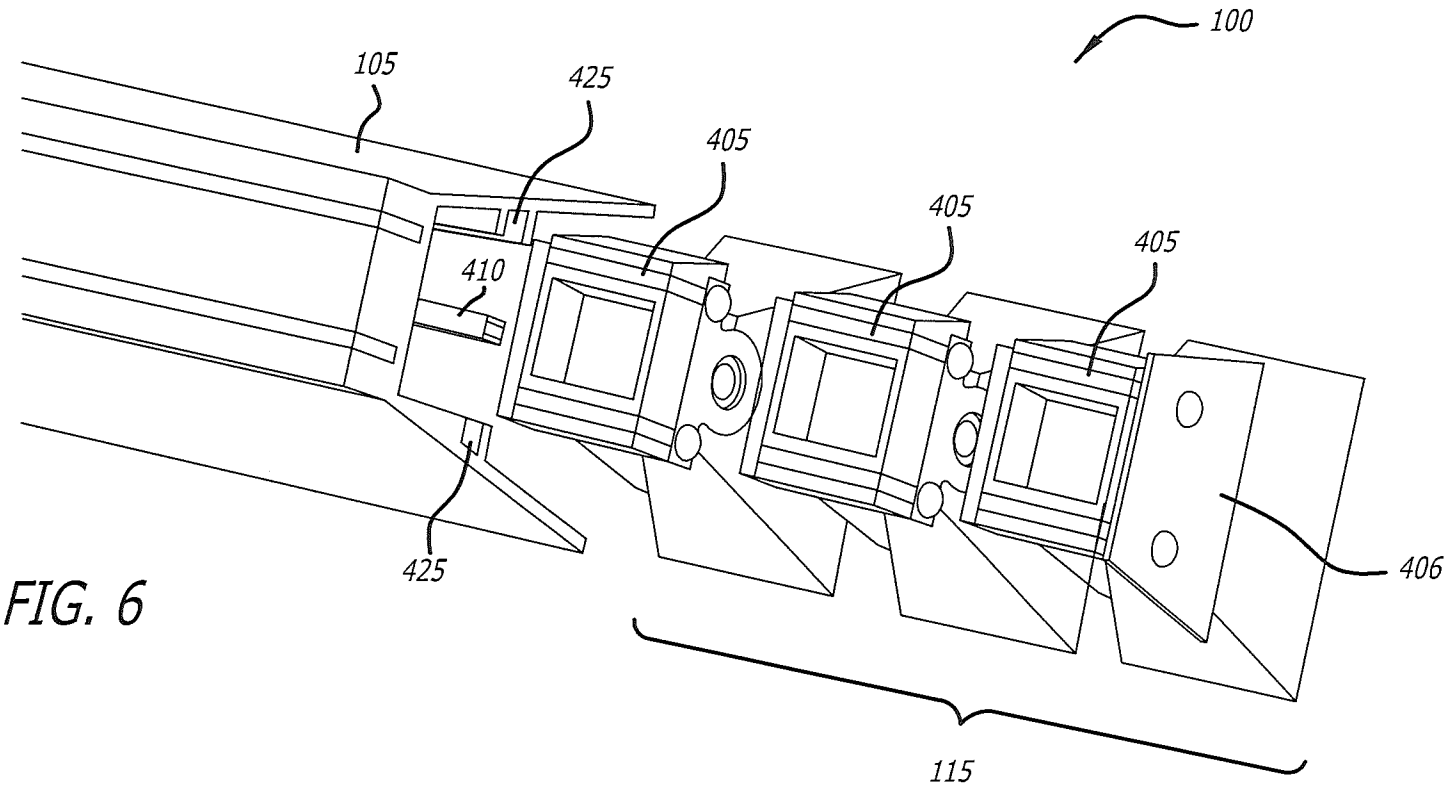
FIG. 6 is a perspective view of the lighting element of the modular lighting system of FIG. 1.

FIG. 6 is a perspective view of the lighting element of the modular lighting system of FIG. 1. In one embodiment, each of the bases 405 include a magnetic retainer 408 that is configured so as to desirably attach with a metal surface. Furthermore, each base 405 includes control port 412 that is configured to engage with the unifying member 410.

Figure 7:
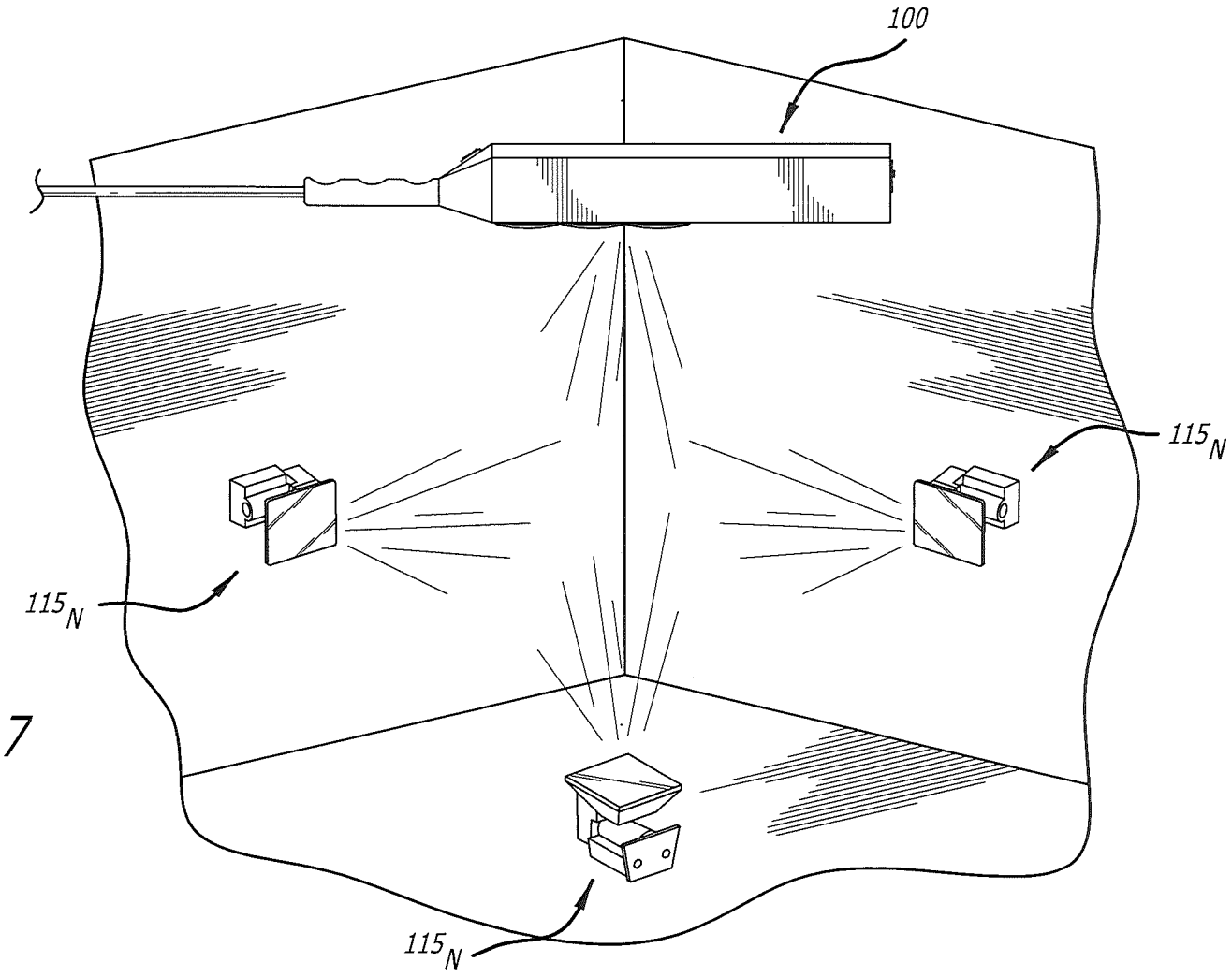
FIG. 7 is a perspective view of an exemplary lighting arrangement using the modular lighting system of FIG. 1.

FIG. 7 is a perspective view of an exemplary lighting arrangement using the modular lighting system of FIG. 1. As shown, each of the detached lighting elements $\mathbf{115}_N$ feature a trapezoidal cross-sectional shape, similar to that of the enclosure 105. It should be understood that the trapezoidal shape provides at least two distinct advantages. First, the output surface area for the light source is greatly increase. Second, the enclosure 105 may be tapered into a smaller shape so that it is easier to handle. In one embodiment, all or some subset of the detachable lighting elements $\mathbf{115}_N$ may be disposed in any of various locations, as the user desires. It will be appreciated that each of the detached lighting elements $\mathbf{115}_N$ may be disposed strategically so as to reduce the incidence of undesirable shadows in a working environment, for example.

Figure 8:
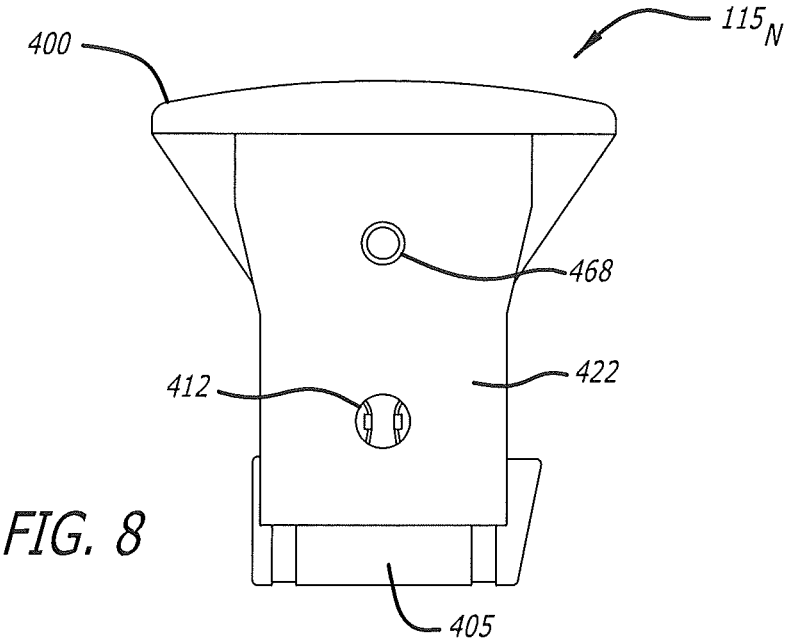
FIG. 8 is a detailed view of a lighting element of the modular lighting system of FIG. 1.

FIG. 8 is a detailed view of a lighting element of the modular lighting system of FIG. 1. In one embodiment, a plurality of user controls 468 are disposed on a surface of the interface retaining medium 422, which may include a number of controls disposed in any of various configurations. For example, the user controls 468 may be disposed in a column configuration, or may be disposed in multiple columns and rows. Other configurations of the user controls 468 will be apparent to those skilled in the art. By way of non-limiting example, the user controls 468 may include an ON/OFF switch, and one or more dimmer functions to control the output of the modular lighting system 100.

Figure 9:
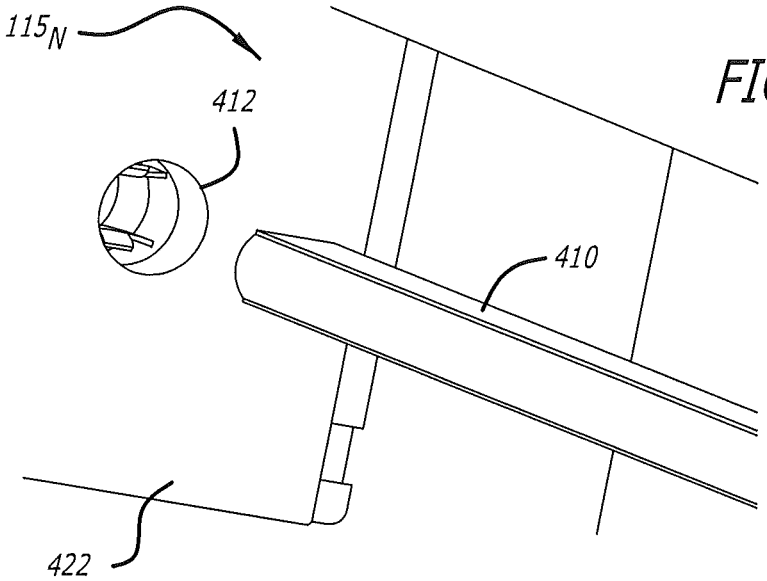
FIG. 9 is a detailed view of a charge port of a lighting element of the modular lighting system of FIG. 1.

FIG. 9 is a detailed view of a charge port of a lighting element of the modular lighting system of FIG. 1. As shown, the unifying member 410 is configured so as to be received by the control port 412. In one embodiment, when each of the lighting element $\mathbf{115}_N$ are attached and/or otherwise coupled with the unifying member 410, the static lighting elements 110 and detachable lighting elements $\mathbf{115}_N$ may all be controlled simultaneously by control functions that may be disposed on the enclosure 105. For example, in one embodiment, each of the lighting elements may be powered on/off, or otherwise dimmed, etc., without limitation.

Figure 10:
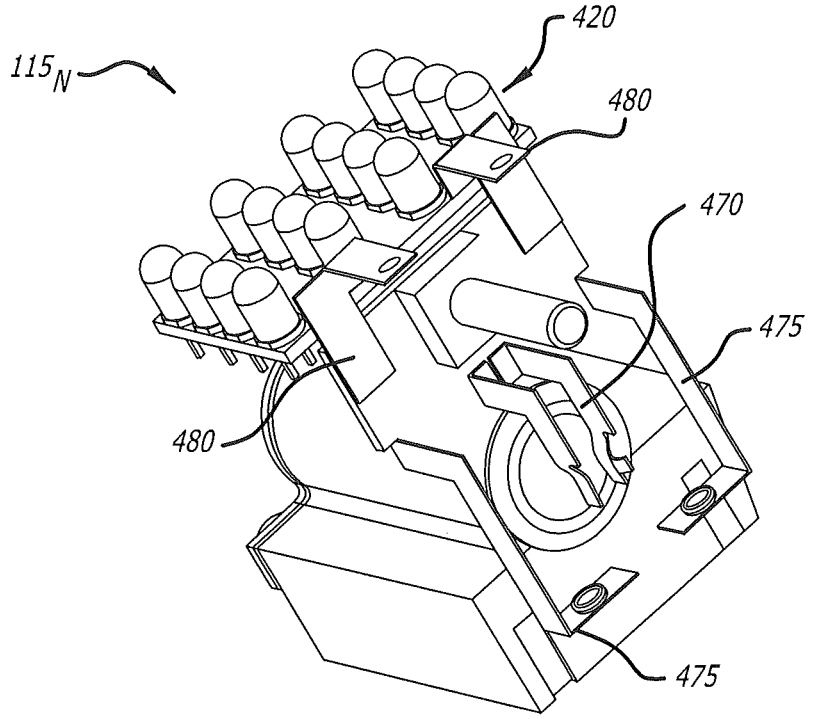
FIG. 10 is a detailed view of the exemplary internals of a lighting element of the modular lighting system of FIG. 1.

FIG. 10 is a detailed view of the exemplary internals of a lighting element of the modular lighting system of FIG. 1. In one embodiment, the lighting sources 420 comprise one or more light emitting diodes (LEDs) disposed in any number of different configurations. As shown, the lighting source 420 comprises a 4×4 grid of LEDs that are configured to output light. It should be understood that any number and types of LEDs may be utilized, without limitation. Also shown is a terminal 470 that is configured so as to communicatively couple with the unifying member 410. As such, the terminal 470 is preferably formed of a conductive material, such as metal. The terminal 470, although shown in a prong-like configuration, may also be implemented in many other ways, depending on the shape of the unifying member 410. In one embodiment, a removable, and potentially rechargeable battery may be disposed between the first pair of posts 475, and the second pair of posts 480. Preferably, the posts 475 are configured to couple with a ground side of the battery, and the posts 480 are configured to couple with the positive side of the battery. It should be understood, however, that this polarity may be reversed depending on the actual implementation of the lighting element 115.

Figure 11:
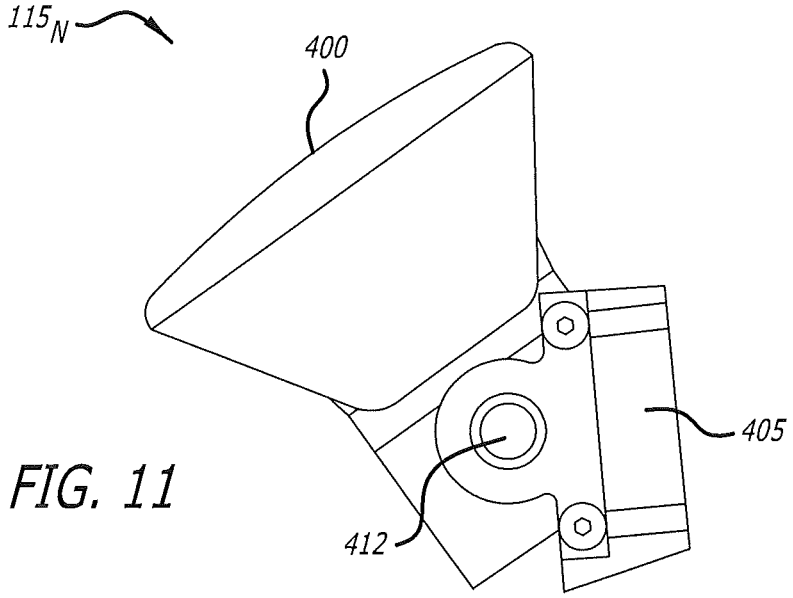
FIG. 11 is a side plan view of an exemplary lighting element in accordance with principles of the disclosure.

FIG. 11 is a side plan view of an exemplary lighting element in accordance with principles of the disclosure. In one embodiment, each of the lighting elements $\mathbf{115}_N$ are configured so that they may swivel about an axis near the base 405. Preferably, each of the lighting elements $\mathbf{115}_N$ are adapted to swivel substantially a full range from zero to ninety degrees. As such, each of the lighting elements $\mathbf{115}_N$ can be adjusted to illuminate work areas with a greater degree of control.

Figure 12:
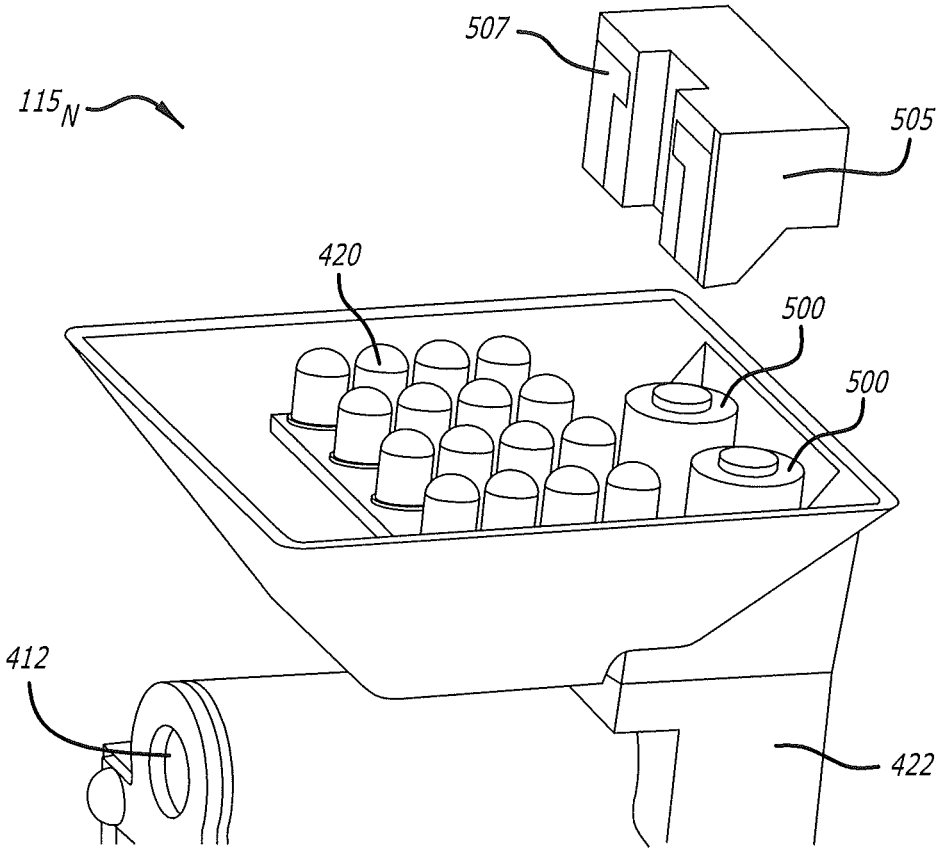
FIG. 12 is a perspective view illustrating access to a plurality of rechargeable batteries in accordance with principles of the disclosure.

FIG. 12 is a perspective view illustrating access to a plurality of rechargeable batteries in accordance with principles of the disclosure. In one embodiment, the diffuser 400 may be removed from the lighting elements $\mathbf{115}_N$, thereby exposing the lighting sources 420 and a plurality of rechargeable batteries 500. In one embodiment, the batteries may be shielded by a cover 505. The cover 505 may feature a substantially plastic construction with metallic elements 507 as necessary to complete one or more circuits, for example.

While the invention has been described in terms of particular variations and illustrative figures, those of ordinary skill in the art will recognize that the invention is not limited to the variations or figures described. In addition, where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially as described above. To the extent there are variations of the invention, which are within the spirit of the disclosure or equivalent to the inventions found in the claims, it is the intent that this patent will cover those variations as well. Therefore, the present disclosure is to be understood as not limited by the specific embodiments described herein, but only by scope of the appended claims.

The invention claimed is:

1. A modular lighting system, comprising:

at least two detachable lighting elements;

an enclosure configured to retain the at least two detachable lighting elements;

a detachable power cable that is capable of being communicatively coupled to a power source;

and wherein each of the at least two detachable lighting elements comprise:

a lighting source;

a base area comprising a magnetic retainer configured to attach with a metal surface of a work area;

and an independent power source; and wherein each of the at least two detachable lighting elements are adapted to swivel, about a swivel axis parallel to the metal surface of the work area and near the base area, substantially a full range from zero to at least ninety degrees within a plane perpendicular to the metal surface of the work area when the base area is attached to the metal surface of the work area, thereby enabling control of degree of illumination of work areas; and wherein the swivel axis of each of the at least two detachable lighting elements is parallel to a longitudinal axis of the enclosure when the at least two detachable lighting elements are retained in the enclosure.

2. The modular lighting system of claim 1, wherein at least three detachable lighting elements are provided.

3. The modular lighting system of claim 1, wherein the lighting source of each of the detachable lighting elements comprises a series of light emitting diodes (LEDs).

4. The modular lighting system of claim 1, wherein the enclosure features a plurality of internal retaining protrusions so as to guide and align the at least two detachable lighting elements in the enclosure.

5. The modular lighting system of claim 1, wherein the static lighting element and the at least two detachable lighting elements may be utilized without being coupled to the power cable.

6. The modular lighting system of claim 1, wherein the detachable lighting elements feature a region capable of storing one or more batteries.

7. The modular lighting system of claim 1, wherein the at least two detachable lighting elements may be detached separately from the enclosure.

8. The modular lighting system of claim 1, wherein the at least two detachable lighting elements may be controlled independently via a control interface.

9. The modular lighting system of claim 1, wherein each of the at least two detachable lighting elements may be controlled via one or more inputs on the enclosure so as to apply various lighting functions.

10. The modular lighting system of claim 1, wherein each of the detachable lighting elements may be controlled via Bluetooth.

11. The modular lighting system of claim 1, wherein the enclosure surrounds all but a light-emitting side of each of the at least two detachable lighting elements.

* * * * *